US005165705A

United States Patent [19]

Huhne

[11] Patent Number: 5,165,705

[45] Date of Patent: Nov. 24, 1992

[54] HIGH-SPEED FLAME SPRAYING GUN HAVING RESISTANT SURFACE FILM

[75] Inventor: Erwin D. Huhne, Schallstadt, Fed. Rep. of Germany

[73] Assignee: UTP Welding Materials Co., Ltd., Bad Krozingen, Fed. Rep. of Germany

[21] Appl. No.: 564,096

[22] Filed: Aug. 8, 1990

[30] Foreign Application Priority Data

Aug. 8, 1989 [DE] Fed. Rep. of Germany ... 8909503[U]

[51] Int. Cl.[5] ..... B05B 7/20

[52] U.S. Cl. ..... 239/79; 239/132.3

[58] Field of Search ..... 239/79, 83

[56] References Cited

U.S. PATENT DOCUMENTS

| | | | |
|---|---|---|---|
| 3,055,591 | 9/1962 | Shephard | 239/79 X |
| 3,112,072 | 11/1963 | Malone | 239/79 |
| 4,004,735 | 1/1977 | Zverev et al. | 239/79 |
| 4,369,748 | 1/1983 | Steinke et al. | 123/424 |
| 4,416,421 | 11/1983 | Browning | 239/79 |

*Primary Examiner*—Andres Kashnikow
*Assistant Examiner*—Kevin P. Weldon
*Attorney, Agent, or Firm*—Staas & Halsey

[57] ABSTRACT

A high-speed flame spraying gun is provided with a water-cooled combustion chamber, an injection gas mixing block and an expanding nozzle. In the high-speed flame spraying gun, the surfaces acted upon by gas and flame possess a surface film which as no affinity to the molten admixed spray material or the other combustion residues. The surface film preferably lines the combustion chamber and/or an expansion nozzle coupled thereto.

12 Claims, 1 Drawing Sheet

HIGH-SPEED FLAME SPRAYING GUN HAVING RESISTANT SURFACE FILM

BACKGROUND OF THE INVENTION

1. Field of the Invention

The present invention relates to a high-speed flame spraying gun with water-cooled combustion chamber, injection gas mixing block and expanding nozzle, in which surfaces acted upon by gas and flame exhibit a surface film with no affinity to admixed spray material or other combustion residues.

2. Description of the Related Art

Existing high-speed flame spraying guns possess a gas mixing block with water-cooled combustion chamber and an expanding nozzle connected at the outlet side. Their superiority to conventional flame spraying guns consists in the fact that the fuel gases (e.g. acetylene, propane or hydrogen) and/or the combustion gases (e.g. oxygen or air) burn in the water-cooled combustion chamber, whereby the gas expands very strongly, with the result that the hot gas stream comes out of the water-cooled expanding nozzle at supersonic speeds.

In this process, the admixed spray material (e.g. in pulverulent form), streams through the combustion chamber, whereby this material is converted into a molten or viscous state. The mixture of fuel and combustion gases also flows into the combustion chamber and is ignited upon entry of the filamentary or pulverulent admixed spray material. In this process, certain technical problems naturally arise: due to the pressure and the gas turbulence in the combustion chamber, the admixed material can not enter the opposite expanding nozzle borehole centrically—a disadvantage. In this way, molten particles of the admixed spray material are slung onto the walls of the combustion chamber or on the front side of the injection gas mixing block, where they bake on or are deposited.

These deposits also occur on the floor of the combustion chamber and in the transition area from the combustion chamber to the expanding nozzle borehole. Since these deposits are occasionally carried off by the high-speed flame and are thrown or shot onto the substratum, they can cause defects in the sprayed film to be produced. For this reason, the traditional coating procedures are not always satisfactory for certain special applications (e.g. high-tech films on airplane engines or gas turbine blades).

With the existing high-speed flame spraying gun, the injection gas mixing block, the combustion chamber and the connected expanding nozzle are normally made of copper, and those of its surfaces which are acted upon by gas and flame are given as smooth a finish as possible.

SUMMARY OF THE INVENTION

An object of the present invention is to create a high-speed flame spraying gun of the type mentioned above in which no deposits of admixed spray material and other combustion residues build up in the region of the combustion chamber.

Another object of the present invention is to provide a surface film in a flame spraying gun that dramatically increases ignition quality of the starting ignition mixture emanating from the expanding nozzle.

These and other objects are achieved by providing the surfaces acted upon by gas and flame with a surface film having no affinity to the molten admixed spray materials or to the combustion residues. In the high-speed flame spraying gun, deposition and baking of admixed spray materials and other combustion residues on the surfaces acted upon by gas and flame are avoided and prevented through the disposition of a surface film which has no affinity to these materials. In this way, the problem created when these deposits are carried off by the high-speed flame and thrown or shot onto the substratum, where they produce defects in the sprayed film, is avoided and eliminated.

The above-mentioned and other objects and features of the present invention will now be described in more detail with the help of the attached drawing, which shows a particular design variant of the present invention.

DETAILED DESCRIPTION OF THE PREFERRED EMBODIMENT

Figure 1:
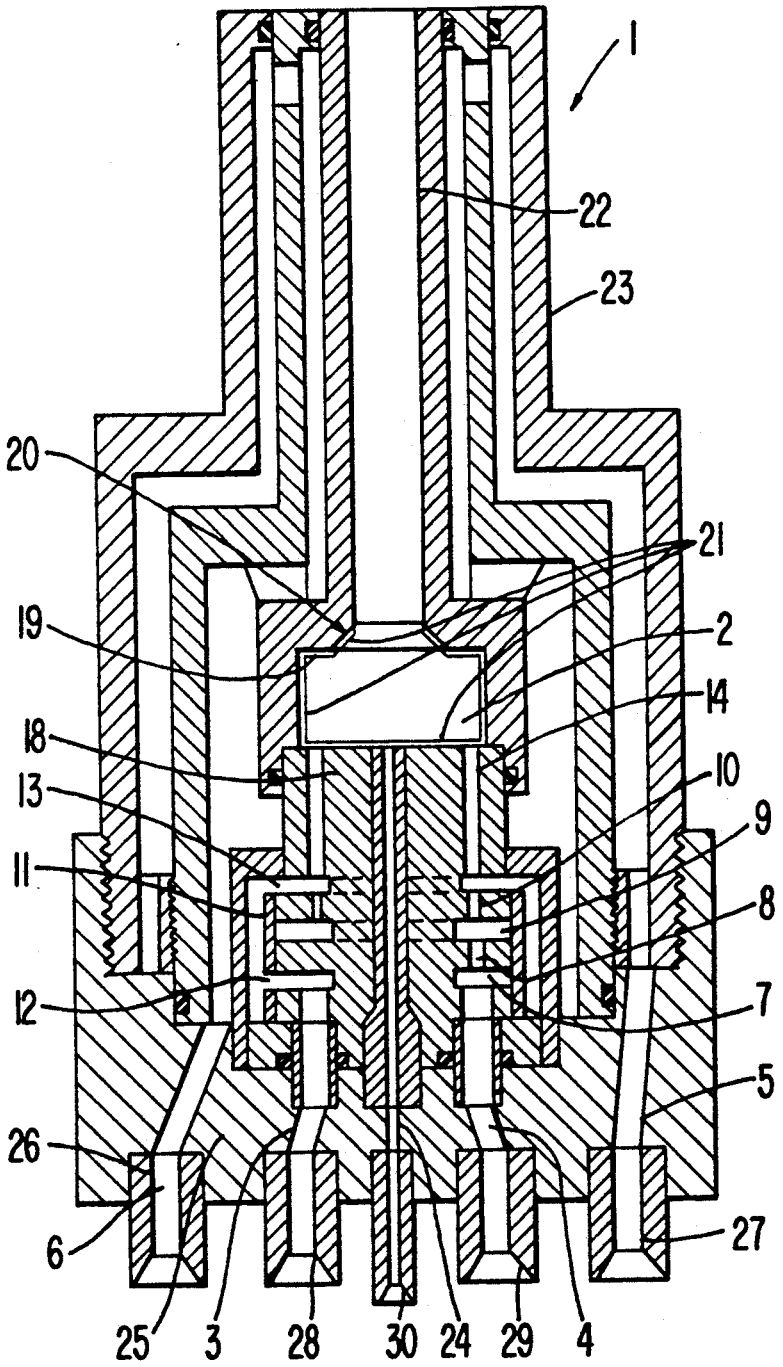
FIG. 1 illustrates a cross-sectional view of the flame spraying gun of the present invention.

FIG. 1 illustrates, among other components, the expanding nozzle 22, the combustion chamber 2, the injection gas mixing block 18 and the water jacket 23 of a high-speed flame spraying gun 1. Various supply and exhaust nozzles 26–30, which are joined to their respective supply and exhaust lines 3–6 and 24, lead into the uptake element 25, to which the injection gas mixing block 18 and the water jacket 23 are connected. In the illustrated embodiment, the fuel gas enters through fuel gas supply line 3 and nozzle 28, the combustion gas enters through combustion gas supply line 4 and nozzle 29 and cooling water enters through cooling water supply line 5 and supply nozzle 27. The cooling water is returned by cooling water discharge line 6 and discharge nozzle 26.

Emanating from a central supply line 24, connected to a supply nozzle 30, the admixed spray material, for example in powdered form, flows through the combustion chamber 2. In the region of the combustion chamber 2, the admixed material is converted into a molten or viscous state. Oxygen, for example, flows through the combustion gas supply line 4 into the transverse slot 7, through the borehole 8, then into a radial slot 9. From here, it flows through the ring slot 13, which is filled with fuel gas and functions as an injector slit, via the injection pressure nozzle borehole 10. The fuel gas then flows into the transverse slot 12 via the supply conduit 3, and from here into the ring space (channel) 11, which is connected to the ring slot (injector slit) 13.

The injector slit 13 is part of the injection system, which consists of the injection pressure nozzle borehole 10, the injector slit 13 and the injection mixing nozzle boreholes 14. It is known that the injection system generates a partial vacuum in the injector slit; in this case, the partial vacuum sucks in the fuel gas (so-called Venturi principle in simplified form).

The combustion gas flows at supersonic speeds out of at least two injection pressure nozzle boreholes 10, through the ring slot (injector slit) 13, then into the injection mixing nozzle boreholes 14; in the process, the combustion gas sucks fuel gas from the injector slit 13 into the injection mixing nozzle boreholes 14, where the fuel and combustion gases are mixed. Then the mixture enters the combustion chamber 2. Due to the disposition of the surface film 21 (which shows no affinity to the admixed spray material or to the combustion residues) on the front side 17 of the injection gas mixing block 18, on the walls of the combustion chamber 16, on the floor of the combustion chamber 19, and on the transition area 20 leading to the expanding nozzle 22, neither the admixed spray material nor the other combustion residues can deposit or bake on in this area.

The problems associated with the current state of the art technology no longer arise with the design of the present invention. These problems occur in the following manner. The filamentary or pulverulent admixed spray materials entering the combustion chamber 2, in which the gas mixture has already ignited, can not enter the opposite expanding nozzle borehole 15 in a centrical manner due to the pressure and gas turbulence in the combustion chamber 2. They are then thrown off in the area of the combustion chamber walls 16, slung onto the front side 17 of the injection gas mixing block 18, onto the floor of the combustion chamber 19 or onto the transition area 20 of the combustion chamber 2 leading to an expanding nozzle borehole 15, where they bake on. Such problems are circumvented by the invention because these materials have no affinity for the surface film 21.

The best substances for the surface film 21 are those from Group VIII of the periodic table, especially platinum. Moreover, some members of the 1st subgroup (Ib) are also suitable, namely gold, silver and ceramic films (e.g. ceramic oxide and carbide films). Heavy metal oxide films, for example titanium oxide, are also suitable.

Application of the surface film 21, for example a gold film, is best accomplished on fully processed components which have already undergone operational tests, for example through the galvanizing process or vapor deposition. The optical film thickness is 1 to 5$\mu$. A surface film 21 with the above-named materials has a dramatically increased ignition quality of the starting ignition mixture emanating from the expanding nozzle.

While the invention has been illustrated and described in detail in the drawing and foregoing description, it will be recognized that many changes and modifications will occur to those skilled in the art. It is therefore intended, by the appended claims, to cover any such changes and modifications as fall within the true spirit and scope of the invention.

What is claimed is:

1. High-speed flame spraying gun for combusting a fuel to act upon an admixed spray material and producing combustion residues, comprising:

a combustion chamber operatively connected to receive the fuel for combustion and to receive the admixed spray material for mixing in said combustion chamber, said combustion chamber coated substantially in its entirety by a surface film of a material having characteristics sufficient to cause substantially no affinity to the admixed spray material or the combustion residues and to reduce accumulation and baking on of the admixed spray material in said combustion chamber;

an injection gas mixing block operatively connected to said combustion chamber; and an expanding nozzle operatively connected to said combustion chamber.

2. A gun according to claim 1, wherein said expanding nozzle is lined by said surface film.

3. A gun according to claim 2, wherein said injection gas mixing block forms part of an inner surface of said combustion chamber; and wherein said inner surface of said combustion chamber is lined by said surface film.

4. A gun according to claim 1, wherein said injection gas mixing block forms part of an inner surface of said combustion chamber; and wherein said inner surface of said combustion chamber is lined by said surface film.

5. A gun according to claim 1, wherein said surface film comprises materials from group VIII of the periodic table.

6. A gun according to claim 5, wherein said surface film comprises platinum.

7. A gun according to claim 1, wherein said surface film comprises materials from subgroup Ib of the periodic table.

8. A gun according to claim 7, wherein said surface film comprises gold.

9. A gun according to claim 7, wherein said surface film comprises silver.

10. A gun according to claim 1, wherein said surface film comprises a ceramic material.

11. A gun according to claim 10, wherein said surface film comprises a ceramic oxide.

12. A gun according to claim 10, wherein said surface film comprises a carbide film.

* * * * *